US005352185A

United States Patent [19]

Blauth et al.

[11] Patent Number: 5,352,185

[45] Date of Patent: Oct. 4, 1994

[54] ANKLE EXERCISING APPARATUS

[75] Inventors: Walter Blauth, Kiel; Ernst Knoll, Umkirch, all of Fed. Rep. of Germany

[73] Assignee: Ernst Knoll Feinmechanik, Umkirch, Fed. Rep. of Germany

[21] Appl. No.: 967,627

[22] Filed: Oct. 27, 1992

[30] Foreign Application Priority Data

Oct. 29, 1991 [DE] Fed. Rep. of Germany ..... 4135552

[51] Int. Cl.[5] ..... A61H 1/00

[52] U.S. Cl. ..... 601/32; 601/31; 601/33; 482/79

[58] Field of Search ..... 482/29, 908, 909; 128/25 R, 25 B, 25 C; 602/27; 601/23, 27, 31–33

[56] References Cited

U.S. PATENT DOCUMENTS

| | | | |
|---|---|---|---|
| 4,229,001 | 10/1980 | Roman | 128/25 C |
| 4,306,714 | 12/1981 | Loomis et al. | 482/79 |
| 4,538,595 | 9/1985 | Hajianpour | 128/25 R |
| 4,650,183 | 3/1987 | McIntyre | 482/79 |
| 4,669,451 | 6/1987 | Blauth | 128/25 R |
| 4,807,874 | 2/1989 | Little | 482/908 |
| 4,834,073 | 5/1989 | Bledsoe et al. | 128/25 C |
| 4,917,343 | 4/1990 | Wainscott | 403/97 |
| 5,170,776 | 3/1990 | Pecheux | 128/25 R |
| 5,197,817 | 3/1993 | Wood et al. | 403/93 |
| 5,211,161 | 5/1993 | Stef | 128/25 B |

FOREIGN PATENT DOCUMENTS

| | | | |
|---|---|---|---|
| 2635457 | 2/1990 | France | 128/25 B |

*Primary Examiner*—Richard J. Apley
*Assistant Examiner*—Jeanne M. Mollo
*Attorney, Agent, or Firm*—Darby & Darby

[57] ABSTRACT

An apparatus for exercising the upper and/or the lower joint of an ankle has a frame which can be placed on the floor or can be mounted on or in a bed and supports an adjustable first support of the lower leg of a patient. The first support movably carries a second support for the foot, and the second support can be moved relative to the first support by two discrete prime movers defining pivot axes one of which can be caused to coincide with the axis of the upper joint and the other of which can be caused to coincide with the axis of the lower joint of the ankle between the lower leg on the first support and the foot on the second support. The operation of each prime mover can be programmed, one of these prime movers can be mounted directly on the first support, and the other prime mover can be mounted on a yoke which is carried by the first support. The other prime mover is adjustable relative to or with the yoke in order to ensure that the apparatus can be used to exercise the ankle for the left foot or the ankle for the right foot.

33 Claims, 7 Drawing Sheets

ANKLE EXERCISING APPARATUS

CROSS-REFERENCE TO RELATED CASES

Commonly owned U.S. Pat. No. 4,669,451 granted Jan. 2, 1987 discloses an apparatus for postoperative and other exercising of elbow and shoulder joints.

Commonly owned copending patent application Ser. No. 07/754,629 discloses an apparatus for postoperative exercising of patients' arms.

Commonly owned copending patent application Ser. No. 07/954,497 filed Sep. 30, 1992 discloses an apparatus for postoperative exercising of patients' legs, namely for the exercising of knee and/or hip joints.

BACKGROUND OF THE INVENTION

The invention relates to exercising apparatus in general, and more particularly to improvements in apparatus for exercising the ankles between the lower legs and feet of patients or other persons who desire to or must exercise one or both ankles, e.g., following an operation.

The ankle between the lower leg and the foot of a person is actually a dual joint. The ankle joint proper (namely the upper or first joint) is disposed between the lower end of the tibia and fibula or calf bone. This joint permits backward and forward or extension and flection movements. A second or lower joint of the ankle is disposed between the astragalus or anklebone and the underlying os calcis or heel bone. This joint permits a movement which can be termed side tipping and involves the so-called pronation and supination of the foot. The first joint defines an axis which extends transversely of the respective lower extremity and permits dorsal extension (lifting of the foot) as well as a plantar flexion (lowering of the foot). The second joint defines an axis extending from the front side of the ankle downwardly and rearwardly to the heel of the foot.

Heretofore known proposals to exercise the ankle involve holding the foot by hands and manually causing the foot to perform the desired movements about the one and/or the other axis. This is a tiresome procedure which must be carried out by a highly skilled person, i.e., such manual exercising is expensive irrespective of whether it is offered to a patient as a postoperative or other treatment in a hospital, sanitarium or a like establishment, or at a patient's home (e.g., by a visiting nurse). Another problem which arises when the exercises are to be performed by hands is that the cost of treatment is greatly increased due to the fact that the exercise must be repeated many times and is likely to stretch out for many weeks or even longer. Still further, relatively small hospitals, sanitaria, nursing homes and like establishments often cannot afford to maintain on the payroll a highly skilled person who specializes in the exercising of ankle joints, especially if such treatments are infrequent. The same holds true for specialists who are to visit a patient's home in order to exercise one or both ankles of such person for required periods at a time as well as to render a requisite number of treatments over a span of one, two or more weeks or months.

OBJECTS OF THE INVENTION

An object of the invention is to provide an apparatus which can be used as a means for exercising one or both ankles of a patient or another person and can be utilized in lieu of manual exercising.

Another object of the invention is to provide an apparatus which is constructed and assembled in such a way that it can exercise the upper and/or the lower joint of an ankle.

A further object of the invention is to provide an exercising apparatus whose operation can be automated to a desired extent.

An additional object of the invention is to provide an apparatus which can be utilized by a prone person or by a person who is seated in a bed or occupies another suitable seating facility.

Still another object of the invention is to provide an apparatus whose operation can be programmed to ensure optimal treatment of an afflicted ankle even if the apparatus is put to use by an unskilled or semi-skilled person.

A further object of the invention is to provide an apparatus which can be rapidly and accurately adjusted to properly position the ankle in the course of an exercising operation.

Another object of the invention is to provide the apparatus with novel and improved means for imparting motion to the parts which support the lower leg (between the ankle and the knee) and the foot of a person requiring exercise.

An additional object of the invention is to provide an apparatus which can be rapidly converted for the exercising of the one or the other ankle and which can be collapsed into a relatively small package prior to storage or transport.

Still another object of the invention is to provide an apparatus which is not uncomfortable to a patient and which enables a patient to devote her or his time to other tasks while the one or the other ankle is being exercised.

A further object of the invention is to provide an apparatus which can be set up to exercise an ankle in an optimal way while the patient is comfortably seated or occupies another comfortable position in or on a bed, chair, sofa or other seating or sleeping facility.

Another object of the invention is to provide the apparatus with novel and improved means for imparting movements to the foot of a patient whose ankle or ankles require exercising.

An additional object of the invention is to provide an apparatus which can be readily set upon on the floor or in or on a bed, depending on the preference and/or condition of the person whose ankle or ankles require exercising.

SUMMARY OF THE INVENTION

The invention resides in the provision of an apparatus for exercising an ankle wherein a first joint permits first movements which are performed about a first axis and include dorsal extension and plantar flexion of a foot relative to a lower leg, and wherein a second joint permits second movements which are performed about a second axis and include supination and pronation of the foot relative to the lower leg. The improved apparatus comprises a frame, a first support for the lower leg of a person (e.g., a patient) desiring to exercise her or his ankle, a second support for the foot of such person, and means for moving at least one of the first and second supports relative to the frame about one of the first and second axes which are defined by the ankle between the lower leg and the foot on the first and second supports, respectively. The supports are mounted on the frame. The moving means preferably comprises means for moving at least the second support relative to the frame and relative to the first support. Such moving means can include a prime mover having an output element which is turnable about a third axis, such third axis at least substantially coinciding with the one axis of the ankle between the lower leg and the foot on the first and second supports, respectively.

In accordance with a presently preferred embodiment, the moving means comprises a first unit having means for pivoting at least one of the supports relative to the other support and relative to the frame about the first axis which is defined by the ankle between the lower leg and the foot on the first and second supports, respectively, and a second unit including means for pivoting at least one of the supports relative to the other support and relative to the frame about the second axis which is defined by the ankle between the lower leg and the foot on the first and second supports, respectively. Each such unit can include a prime mover having an output element turnable about an axis which at least substantially coincides with the respective axis of the ankle between the lower leg and the foot on the first and second supports, respectively, and means for operating the prime movers. Such operating means can include means for starting, arresting and/or changing the speed of the prime movers independently of each other, and the apparatus can further comprise means for adjusting the two units relative to the ankle between the lower leg and the foot on the first and second supports, respectively.

The adjusting means of the improved apparatus (irrespective of the number of units in the moving means) can comprise means for adjusting the second support relative to the frame, and such adjusting means can include a carrier for the second support. The prime mover of the means for moving the second support relative to the first support and relative to the frame can include a motor (e.g., an electric stepping motor) having an output element which is connected with and serves to pivot the carrier and the second support relative to the frame about the respective axis of the ankle between the lower leg and the foot on the respective supports. The adjusting means of the just outlined character can further comprise means for adjusting the first support relative to the frame. If the one axis is the first axis of the ankle between the lower leg and the foot on the respective supports, and the moving means includes a discrete moving unit for each of the two axes of the ankle, the unit for moving the foot about the second axis of the ankle comprises a second prime mover which is or can be mounted between the carrier and the second support and has a second output element which is connected with and serves to pivot the second support about the second axis of the ankle between the lower leg and the foot on the respective supports. In accordance with a presently preferred embodiment, the carrier can comprise a yoke which is pivotable relative to the frame about the first axis of the ankle between the lower leg and the foot on the respective supports. The yoke is or can be mounted in such a way that it has a first side facing toward and a second side facing away from the first support, and the second output element is preferably disposed at the first side of the yoke. The just described embodiment of the improved apparatus can further comprise means for adjustably coupling the second prime mover to the carrier to permit positioning of the second output element for pivoting of the second support about the second axis of the ankle between a left foot or a right foot and a left lower leg or a right lower leg on the respective supports.

The frame can include a base and means for securing the first support to the base.

The apparatus can comprise means (such as the aforementioned securing means) for changing the position of the first support relative to the frame, and such position changing means can include means for moving the first support between a plurality of different levels relative to the frame and/or means for changing the orientation of the first support relative to the frame. The position changing means can comprise two pairs of arms which are disposed in substantially parallel planes at opposite sides of the first support. The arms of each pair can include first portions which are pivoted to spaced-apart sections of the frame and second portions which are preferably adjustably connected to each other and mount the first support. Such position changing means can further comprise means for releasably fixing the second portions of the arms of each pair to each other. Each such fixing means is or can be adjustable longitudinally of at least one arm of the respective pair of arms, and each fixing means can be secured to the second portion of one arm of the respective pair of arms and can include guide means (e.g., a through hole or bore or a channel) slidably receiving the other arm of the respective pair of arms. Still further, the position changing means can comprise a connector (e.g., an elongated shaft) between the two fixing means, and the first support is then (directly or indirectly) mounted on such connector. The first support is preferably pivotable between a plurality of positions relative to the fixing means, and such pivoting takes place about the first axis of the ankle between the lower leg and the foot on the respective supports. The position changing means can further comprise or cooperates with means for releasably locking the first support in a selected position. Such means for releasably locking can comprise an additional arm which is pivoted to the frame, and means for releasably fixing the additional arm to the first support.

The frame can include a holder for the supports and means for separably coupling the holder to a supporting structure, e.g., to the frame of a bed in a hospital, in a sanitarium, in a nursing home, in a private home or in another establishment which is accessible to or is owned by a person who is desirous of exercising her or his ankle(s).

The moving means can include a motor and a self-locking transmission between the motor and the at least one support or the respective support if the moving means comprises a moving unit for each support. The transmission can include a worm drive or any other suitable means which maintains the respective support in a selected position until and unless the motor is started in a direction to effect a desired pivoting of the foot about the one and/or the other axis.

The moving means can comprise one or more prime movers, e.g., one or more reversible electric motors, and means for operating the prime mover or prime movers in accordance with at least one predetermined program. The operating means can further comprise means for monitoring the position(s) of the support(s) and for generating signals which denote the monitored position(s). The operating means can further comprise or cooperate with means for limiting the extent of movability of the support(s) relative to the frame; such limiting means can include one or more mechanical stops, limit switches or other suitable means which determine the extent of movability of the second support and of the foot resting on the second support relative to the first support and the lower leg resting on the first support.

The moving means can include a housing for each unit and a prime mover in the housing. The output element of such prime mover defines a third axis. The ankle between the lower leg and the foot on the respective supports is movable with and/or relative to at least one of the supports to move the one or the other axis of such ankle to a position of at least substantial coincidence with the third axis.

The frame can include a base and at least one carrier device which is movably affixed to the base and mounts the first support. For example, the base can include a substantially U-shaped member and the frame can further comprise a pivot member between the base and the at least one carrier device. The latter is movable relative to the base—about a further axis which is defined by the pivot member—between a plurality of different angular positions, and such frame preferably further comprises a detent having means for releasably locking the carrier device in a selected angular position. The detent means can further include at least one bearing for the pivot member, and the locking means of the detent can include at least one first portion on the at least one bearing and at least one second portion which is complementary to the at least one first portion and is provided on the carrier device. One of the first and second portions of the locking means can include a plurality of sockets and the other portion can include a projection receivable in a selected socket of the one portion. It is also possible to provide a single socket and a plurality of projections. The other portion of the locking means can be provided on the carrier device, and the apparatus can further comprise coil springs and/or other suitable means for biasing the projection into a selected socket and means (e.g., a handle) for extracting the projection from the selected socket.

The frame can further comprise a shaft which is rotatably supported by the at least one carrier device and mounts the first support, and means for releasably maintaining the shaft and the first support in any one of a plurality of different angular positions relative to the at least one carrier device. The means for releasably maintaining can comprise a first detent portion on the shaft and a second detent portion on the at least one carrier device. The two detent portions are separably connectable to each other in any one of the aforementioned plurality of different angular positions of the shaft and the first support relative to the at least one carrier device.

The first support can comprise two elongated components (e.g,, in the form of tubes or rods) and braces which connect these components to the shaft on the at least one carrier device.

The novel features which are considered as characteristic of the invention are set forth in particular in the appended claims. The improved exercising apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
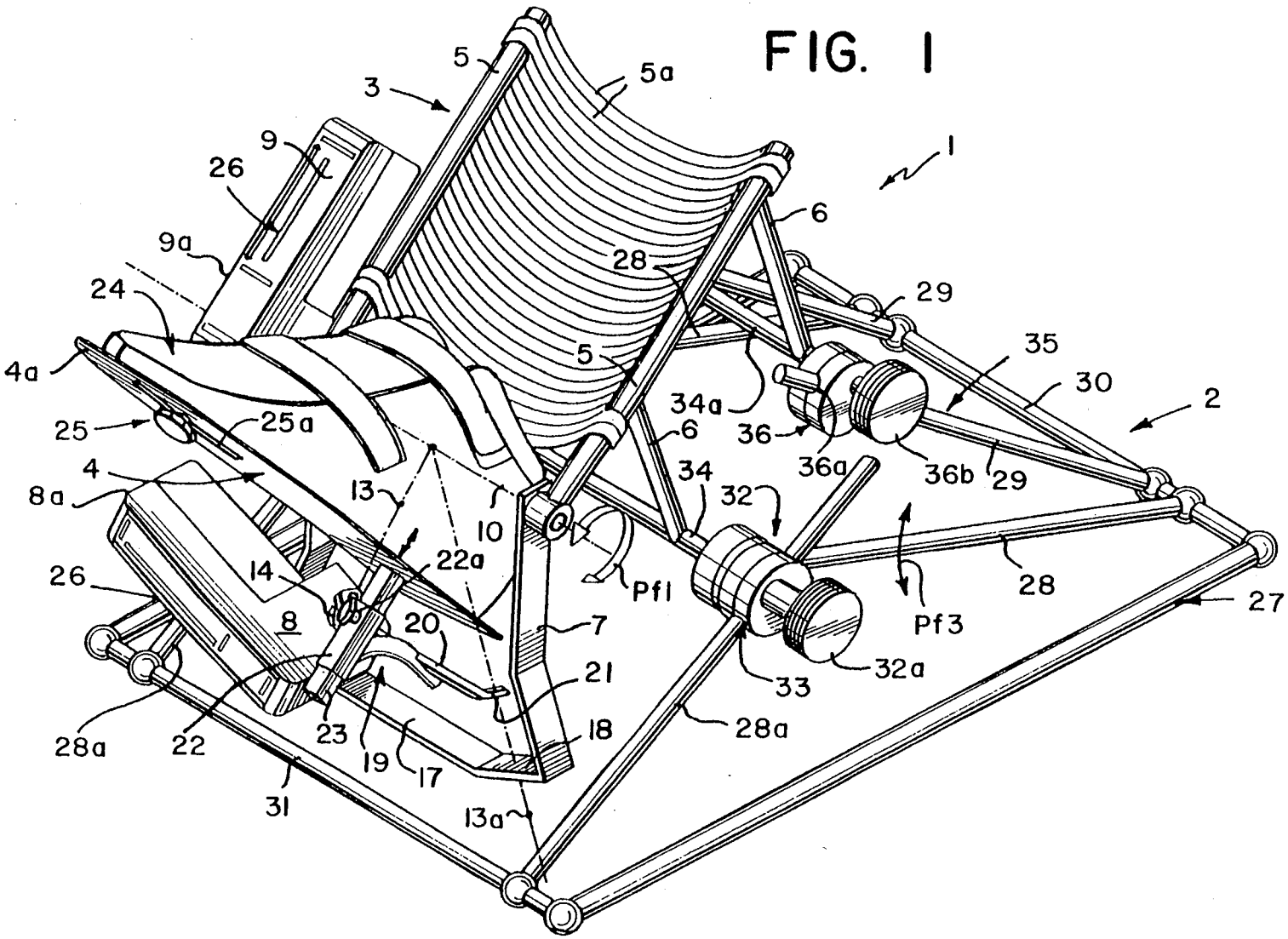
FIG. 1 is a schematic perspective view of an ankle exercising apparatus which embodies one form of the invention.

The apparatus 1 which is shown in FIGS. 1 to 4 is designed to exercise the ankle A between the foot 11 and the lower leg L of a patient or another person who desires or requires such treatment. The apparatus 1 comprises a frame 2 having a base 27 which can be placed onto a floor, a first support 3 which serves to carry the lower leg L and is carried by the frame 2, and a second support 4 for the foot 11. The second support 4 is movably mounted on the first support 3, and the latter is adjustable relative to the frame 2. The ranges of adjustabilities of supports 3, 4 relative to each other and relative to the frame 2 are selected with a view to ensure that the axes (10 and 13 or **13*a*) about which the properly adjusted support 4 (with the foot 11 thereon) is movable relative to the support 3 and frame 2 in the course of an exercise coincide or at least nearly coincide with the axes of the respective joints (shown at 16 and 15 in FIG. 4) of the ankle A between the lower leg L on the first support 3 and the foot 11 on the second support 4**.

The support 4 can resemble or include a shoe-like receptacle part or 24 for a foot 11, and the support 3 can be provided with or can otherwise cooperate with hook and loop fasteners, adhesive tape or the like to adequately immobilize the lower leg L in the course of an exercise. The illustrated support 3 comprises two elongated spaced apart components 5 in the form of rods, bars or tubes, a plurality of flexible bands **5*a* of textile or other suitable material between the components 5, and brackets 6 which form part of means for connecting the components 5 to the frame 2. The bands 5*a*** can be replaced with a continuous sheet of textile or plastic material, e.g., a sheet of canvas.

Those ends of the components 5 which are adjacent the support 4 carry the ends of a substantially U-shaped carrier or yoke 7 for the support 4. The yoke 7 is pivotable relative to the support 3 in directions indicated by a double-headed arrow Pf1, namely about the first axis 10 which should coincide with the axis of the first or upper joint 16 of the ankle A. The support 4 is mounted on the yoke 7 by way of a prime mover 8 forming part of means for moving the support 4 relative to the support 3 (and relative to the frame 2) about the axis 10 and/or about the axis 13 or 13*a*, depending on the nature of exercise to be performed by the ankle A. A second prime mover 9 of the moving means serves to move the support 4 relative to the support 3 in directions indicated by the double-headed arrow Pf1. This results in a lifting (dorsal extension) or lowering (plantar flexion) of the foot 11 relative to the lower leg L. The angle of pivotability of the support 4 about the axis 10 for the purpose of carrying out a plantar flexion need not exceed 40°, and the angle to carry out a dorsal extension need not exceed 30°.

Figure 3:
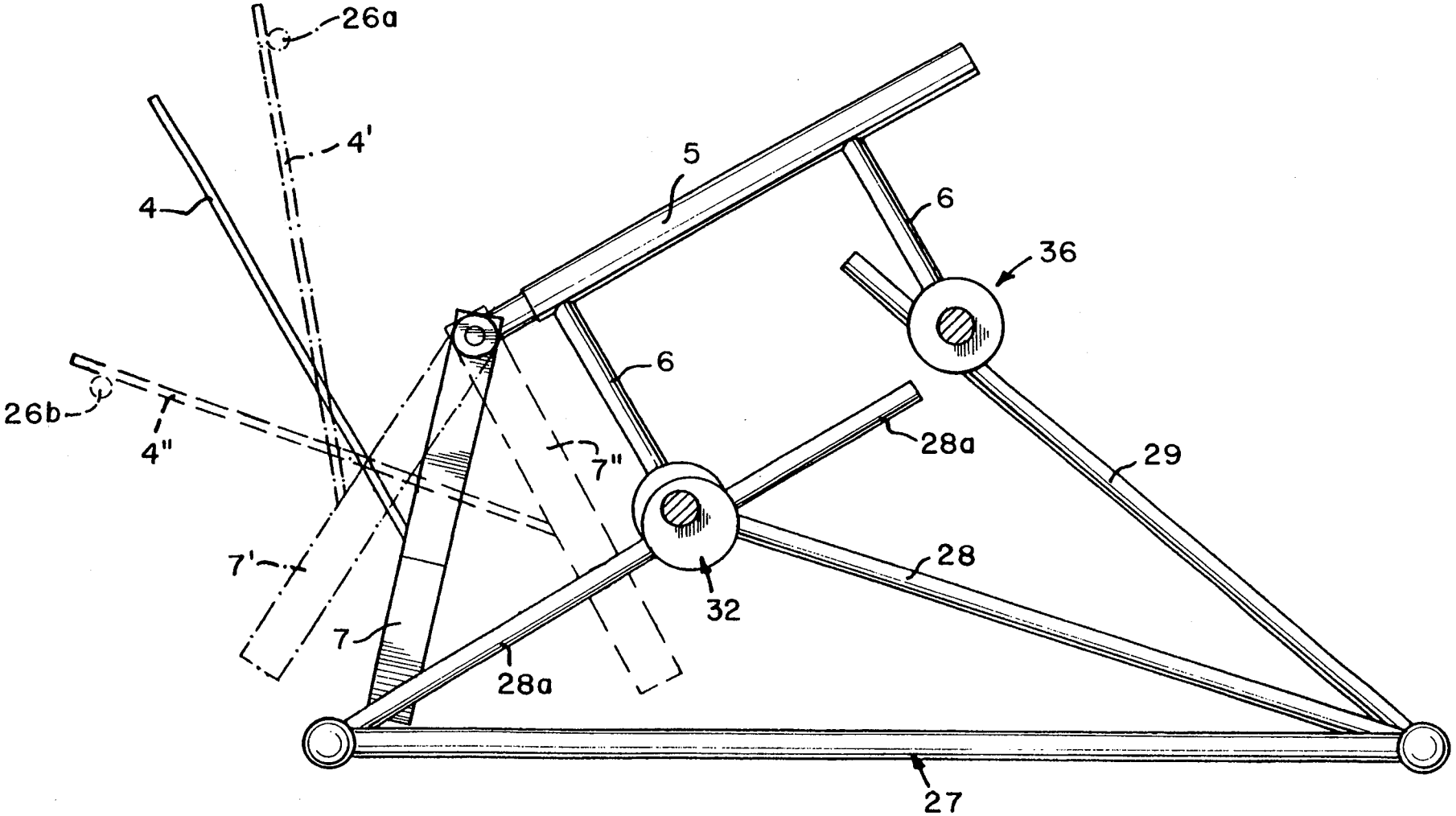
FIG. 3 is a side elevational view of the frame and of certain parts of the support for the lower leg, the support for the foot being shown schematically in three different positions relative to the frame and the other support.
Figure 4:
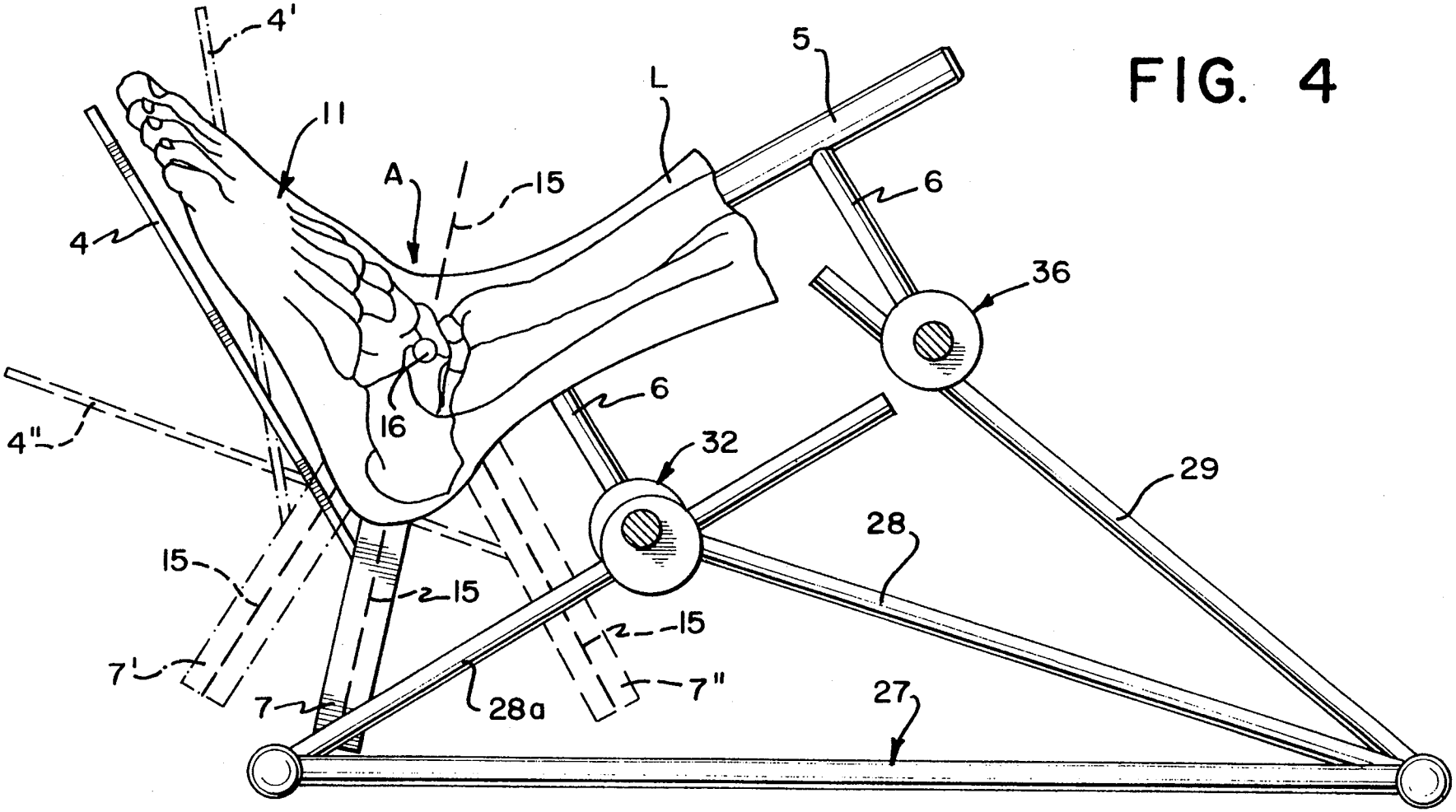
FIG. 4 is a view similar to that of FIG. 3 but further showing the foot and a portion of the lower leg on the respective supports.

A neutral position of the second support 4 is indicated in FIGS. 3 and 4 by solid lines. One end position (namely the fully lifted position) of the support 4 is indicated by dot-dash lines, as at 4′, and the other end position (namely the fully lowered position) of the support 4 is indicated by broken lines, as at 4″. The corresponding positions of the yoke 7 are also indicated by solid lines, by dot-dash lines (at 7′) and by broken lines (at 7″), respectively.

Figure 2:
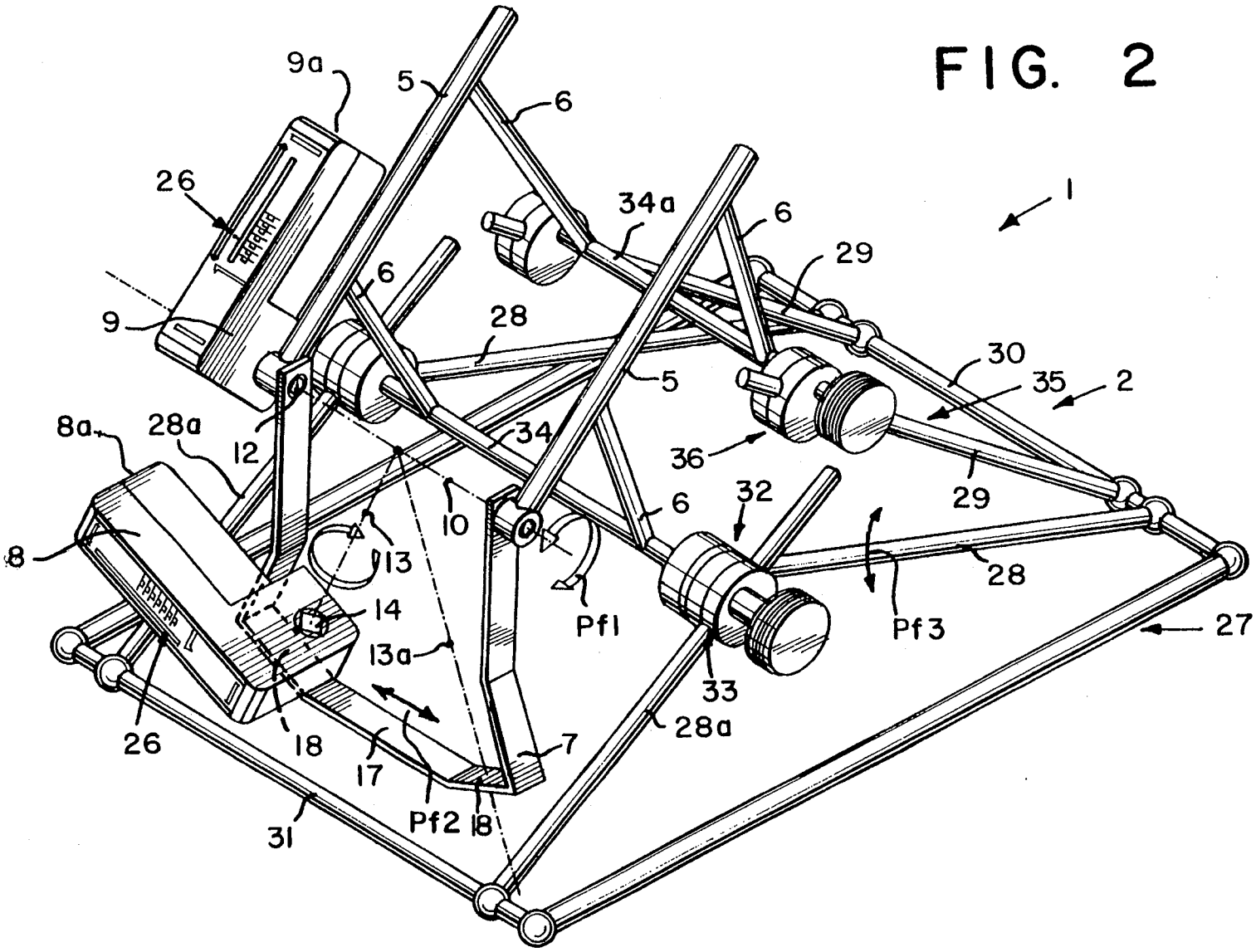
FIG. 2 is a similar perspective view of the exercising apparatus but with the supports for the lower leg and the foot removed.
Figure 5:
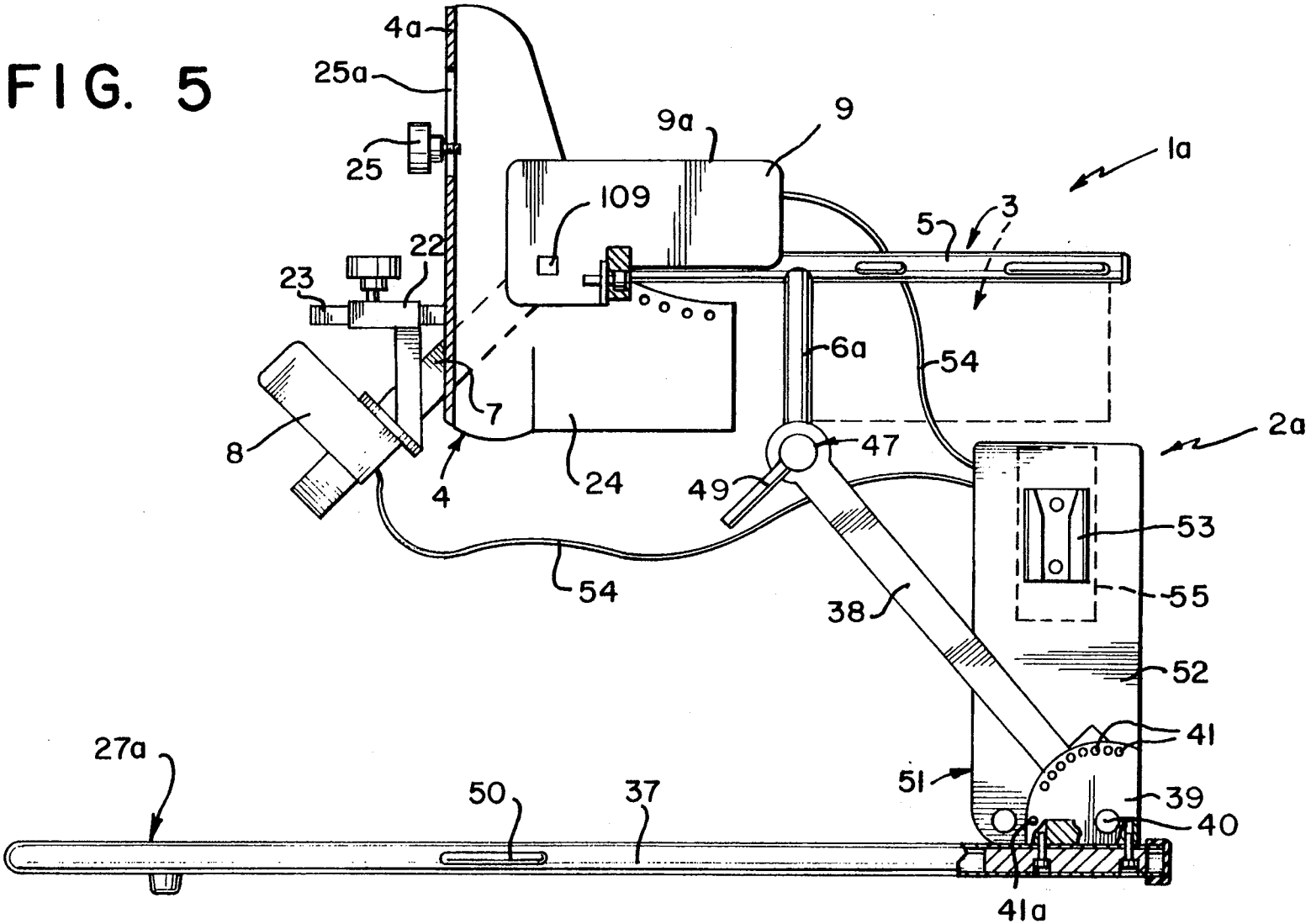
FIG. 5 is a schematic side elevational view of a modified exercising apparatus which employs a different frame.

The prime movers 8 and 9 of the moving means for the support 4 include electric motors which are installed in housings 8*a* and 9*a*, respectively, and transmissions (the transmission 109 in the housing 9*a* is indicated in FIG. 5) with rotary output elements 14 and 12, respectively. The transmissions can be of the self-locking type (e.g., each such transmission can include a worm and worm wheel drive) to ensure that the position of the support 4 changes only as long as the motor of the respective prime mover 8 or 9 is in operation. The housing 8*a* of the prime mover 9 which is shown in FIG. 2 is secured to the web 17 of the yoke 7. The housing 9*a* of the prime mover 9 which is shown in FIG. 2 is connected with one component 5 of the first support 3.

The prime mover 8 and its output element 14 share the angular movements of the yoke 7 and support 4 about the axis 10. The housing 8*a* is preferably adjustable longitudinally of the web 17 of the yoke or carrier 7 (note the double-headed arrow Pf2). This is desirable and advantageous because the supports 3, 4 can be used to properly position a left foot 11 and the corresponding lower leg L or a right foot 11 and the corresponding lower leg L. All that is necessary is to align the axis 13 or 13*a* of the output element 14 with the axis of the second joint 15 of the ankle A between the foot 11 on the support 4 and the lower leg L on the support 3. The axis of the lower or second joint 15 of the ankle A extends rearwardly and downwardly from the front side of the lower part of the lower leg L on the support 3 toward the heel bone of the foot 11 on the support 4. It is assumed here that the base 27 of the frame 2 is mounted on a horizontal supporting structure (e.g., on a floor) and that the support 3 slopes downwardly toward the support 4.

The upper joint 16 of the ankle A defines an axis which extends transversely of the extremity including the lower leg L and the foot 11 of FIG. 4 and is substantially horizontal in the illustrated positions of the supports 3 and 4. The axis of this upper joint 16 should coincide with the axis 10 of the output element 12 of the prime mover 9 when the improved exercising apparatus 1 is ready for use.

FIG. 1 shows the prime mover 9 and the output element 14 of its transmission 109 in positions they assume when the apparatus 1 is ready for the exercising of a right foot 11. As already mentioned above, the prime mover 8 can be shifted in one of the directions indicated by the arrow Pf2 in order to ensure that the axis 13 of the output element 14 will coincide with the axis of the second joint 15 of a left foot 11 if such left foot happens to be resting on the support 4. The web 17 of the yoke or carrier 7 has suitably inclined end portions 18 which can serve as stops to arrest the housing 8*a* of the prime mover 8 in a proper position for the exercising of the ankle A for a left leg 11 or a right foot 11. The axis of the output element 14 for the exercising of a right leg 11 is indicated in FIGS. 1 and 2, as at 13*a*.

The output element 14 of the prime mover 8 is accessible from two sides so that the means 19 for coupling the output element 14 to the support 4 can be attached at the one or the other side of the element 14. In order to enhance the compactness of the apparatus 1, the prime mover 8 is mounted at a level beneath the foot 11 on the support 4 in line with the imaginary extension of the axis of the lower joint 15 of the ankle A.

The coupling means 19 for the support 4 includes a pivotable arm 20 with two bent end portions 21 (one can be seen in FIG. 1). The median portion of the arm 20 (which resembles a weighbeam) is connected to a tubular member or sleeve 22. One of the end portions 21 is connected with the output element 14 in one end position of the prime mover 8 relative to the web 17, and the other end portion 21 is connectable with the output element 14 in the other end position of the prime mover 8 on the yoke 7. The support 4 carries an elongated stub 23 which can be received in the sleeve 22 and can be clamped thereto by a screw 22*a* or in any other suitable way. The stub 23 extends at right angles to the plane of the underside of a platform 4*a* forming part of the second support 4. The coupling means 19 is designed in such a way that it can be properly mounted at either side of the output element 14 and can be properly coupled to the stub 23 of the support 4. This is achieved by appropriate shaping of the end portions 21 of the arm 20 and by proper selection of the position of the sleeve 22 relative to the stub 23. The shoe-like part 24 of the support 4 is preferably adjustable relative to the platform 4*a*, i.e., relative to the stub 23. This, too, facilitates proper positioning of the axis of the lower joint 15 of the ankle A relative to the axis (13 or 13*a*) of the output element 14 of the prime mover 9 on the yoke 7 and relative to the axis 10 of the output element 12 of the prime mover 9 on the respective component 5 of the first support 3. The shoe-like part 24 can be fixed to the platform 4*a* of the support 4 in a selected position by means of a screw 25 which is shown in FIG. 1. To this end, the shank of the screw 25 extends through an elongated slot 25*a* of the platform 4*a* and into a tapped bore or hole of the shoe-like part 24.

If desired or necessary, the parts 4*a* and 24 can be adjustably connected to each other for movement in directions at right angles to the longitudinal direction of the slot 25*a*. This would contribute to even greater adjustability of the shoe-like part 24 relative to the platform 4*a*.

The means for operating the motors of the prime movers 8 and 9 are shown at 26. Such operating means include means for programming the operation of the respective motors to select the extent of angular movability of the respective output elements 12, 14 and hence the nature of the exercise for the ankle A. The operating means 26 are adjustable to select the angular movability of the respective output elements 12, 14, the frequency of movements of the foot 11 relative to the lower leg L, the speed of such movement and/or other factors which influence the effect of the exercise. The programming means of each operating means 26 can be adjusted to select the extent of angular movability of the respective output elements 12, 14 as well as the frequency of exercises per hour or during another selected interval of time. Once a program is selected, it can be repeated automatically at given intervals a given number of times, either at a regular or at an irregular frequency. The operation of the prime mover 8 can be programmed independently of that of the prime mover 9, and each of these prime movers can be started, arrested, accelerated or decelerated independently of the other prime mover. This contributes to versatility of the improved exercising apparatus 1. The arrangement may be such that the prime movers 8, 9 are in operation simultaneously (e.g., if the two joints 15, 16 of the ankle A are to perform a series of rather complex movements) or one after the other. Alternatively, one of the prime movers 8, 9 can remain idle if the nature of the exercise is such that the foot 11 should be pivoted only about the axis which is defined by the joint 15 or only about the axis which is defined by the joint 16.

The operating means 26 can include or can be combined with suitable monitoring means which generate signals when the support 4 reaches a certain position in response to operation of the prime mover 8 and/or 9. Such monitoring means can include photoelectronic detectors, limit switches or the like. Two limit switches **26*a* and 26*b* are shown in FIG. 3; the signals from such limit switches are transmitted to the programming means of the respective operating means 26** for evaluation and can be used to trigger the next stage of exercising.

The frame 2 includes the aforementioned base 27 which can be placed onto the floor or onto another suitable supporting structure. The base 27 includes two spaced apart parallel frame members 30, 31 which define pivot axes for arms **28, 28*a*, respectively. These arms form part of a means for securing the support 3 to the frame 2, and such securing means simultaneously serves as a means for changing the position of the support 3 relative to the frame 2. The arms 28, 28*a* form two pairs disposed in planes which are normal to the plane of the base 27 and flank the support 3 for the lower leg L. One end portion of each arm 28 is pivotable on the frame member 30, one end portion of each arm 28*a* is pivotable on the frame member 31, and the other end portion of each arm 28 is affixed to a discrete clamping device 32 serving as a means for releasably fixing the second portion of the arm 28 to a selected part (e.g., to the second portion) of the associated arm 28*a*. The clamping devices 32 have guide means 33 (e.g., bores or holes or channels) which slidably receive the second portions of the arms 28*a*. This renders it possible to change the level of the support 3 which is mounted on a horizontal connector or shaft 34 extending between the two clamping devices 32. The shaft 34 carries the brackets 6 which, in turn, are connected to the components 5 of the support 3. Knobs 32*a* are provided to lock the arms 28*a* to the respective clamping devices 32 when the support 3 assumes an optimum level. The directions of pivotability of one of the arms 28 shown in FIG. 1** are denoted by an arrow Pf3.

The orientation (inclination) of the support 3 relative to the base 27 of the frame 2 can be varied by two additional arms 29 which are pivotable about the frame member 30 and can be releasably fixed to the adjacent brackets 6 of the support 3 by clamping devices 36. The arms 29 and the clamping devices 36 form part of a device 35 which serves to releasably lock the support 3 in a selected angular position relative to the frame 2 and further includes a shaft **34*a* connected with the adjacent brackets 6 and carrying the clamping devices 36. These clamping devices have guide means 36*a* in the form of holes or bores or channels 36*a* for the adjacent portions of the additional arms 29. Fasteners 36*a* are provided to fix the clamping devices 36 to the respective additional arms 29 when the inclination of the support 3 relative to the base 27 of the frame 2 reaches an optimum value. The shaft 34*a* is parallel to and is spaced apart from the shaft 34**.

The just discussed adjustability of the support 3 relative to the frame 2 enables a person in charge to rapidly and accurately locate the lower leg L, the ankle A and the foot 11 of a patient in optimum positions with reference to the axes 10 and 13 or **13*a*. For example, the adjustment of the support 3 relative to the frame 2 will necessitate a change if a patient desires to change her or his position from lying down to sitting or vice versa. Still further, the person in charge of adjusting the level and inclination of the support 3** can take into consideration the angle between the leg portion extending from the ankle to the knee and the leg portion extending from the knee to the hip of the patient. Alternatively, or in addition to such adjustment, the person in charge can take into consideration the angle between the upper part of the leg and the torso of a patient, i.e., the position of the hip joint.

The base 27 of the frame 2 can be replaced with or it can be used in combination with a device which serves to releasably clamp the frame to the bed of a patient in a hospital, sanitarium, nursing home or a similar establishment.

The improved exercising apparatus 1 can be simplified by omitting one of the prime movers 8, 9 if the apparatus is to be used exclusively for carrying out an exercise which involves pivoting about the axis defined by the first ankle joint 16 or about the axis defined by the second ankle joint 15. Furthermore, some of the aforediscussed portions of various adjusting means for the support 3 and/or 4 can be omitted in order to reduce the cost without unduly reducing the versatility of the apparatus.

An important advantage of the aforedescribed exercising apparatus is its compactness. Moreover, the apparatus is relatively simple and highly versatile, i.e., it can be used to carry out any desired exercise and its supports 3, 4 can be readily and rapidly adjusted to ensure that the lower leg L, the ankle A and the foot 11 will be maintained in optimum positions in the course of one or more exercises. The illustrated apparatus constitutes an improvement and a further development of apparatus which are disclosed in the commonly owned copending patent application Ser. No. 07/954,497 filed Sep. 30, 1992 and which are capable of causing the leg of a patient to perform movements in the regions of the hip joint, of the knee joint and the first or upper joint of the ankle. As already mentioned hereinbefore, exercising of the lower ankle joint is presently carried out by hand, and such treatment takes up much time and must be entrusted to highly trained and skilled persons.

Accurate positioning of the ankle A relative to the supports 3 and 4 is of great importance in connection with a number of post-operative exercises in order to ensure predictable and rapid healing and recovery. It is also important, in connection with numerous postoperative treatments, to ensure that the movements of the foot relative to the lower leg are carried out to an optimum extent, at an optimum speed and at an optimum frequency. All this can be readily achieved by resorting to the apparatus of FIGS. 1 to 4. In fact, the improved apparatus can cause the two joints of the ankle A to perform exercises whose complexity is well beyond that achievable by resorting to manual treatment. Accurate positioning of the ankle A, foot 11 and lower leg L ensures that the ankle is not subjected to any appreciable compressive or tensional stresses and/or to any other stresses which could be painful and would fail to promote recovery of the patient after an operation. Since the supports 3 and 4 can be accurately positioned relative to each other and relative to the frame 2, the improved apparatus can be put to use shortly after an operation, a procedure which is desirable in most instances.

The provision of independent operating means 26 for each of the prime movers 8 and 9 also contributes to utility and versatility of the improved exercising apparatus. For example, the supports 3 and 4 can be properly adjusted prior to a treatment which involves pivoting the carrier or yoke 7 by the prime mover 9 and thereafter turning the support 4 about the axis 13 or 13*a*. Such turning can be followed by simultaneous exercising of both ankle joints, i.e., by simultaneous operation of both prime movers.

Figure 6:
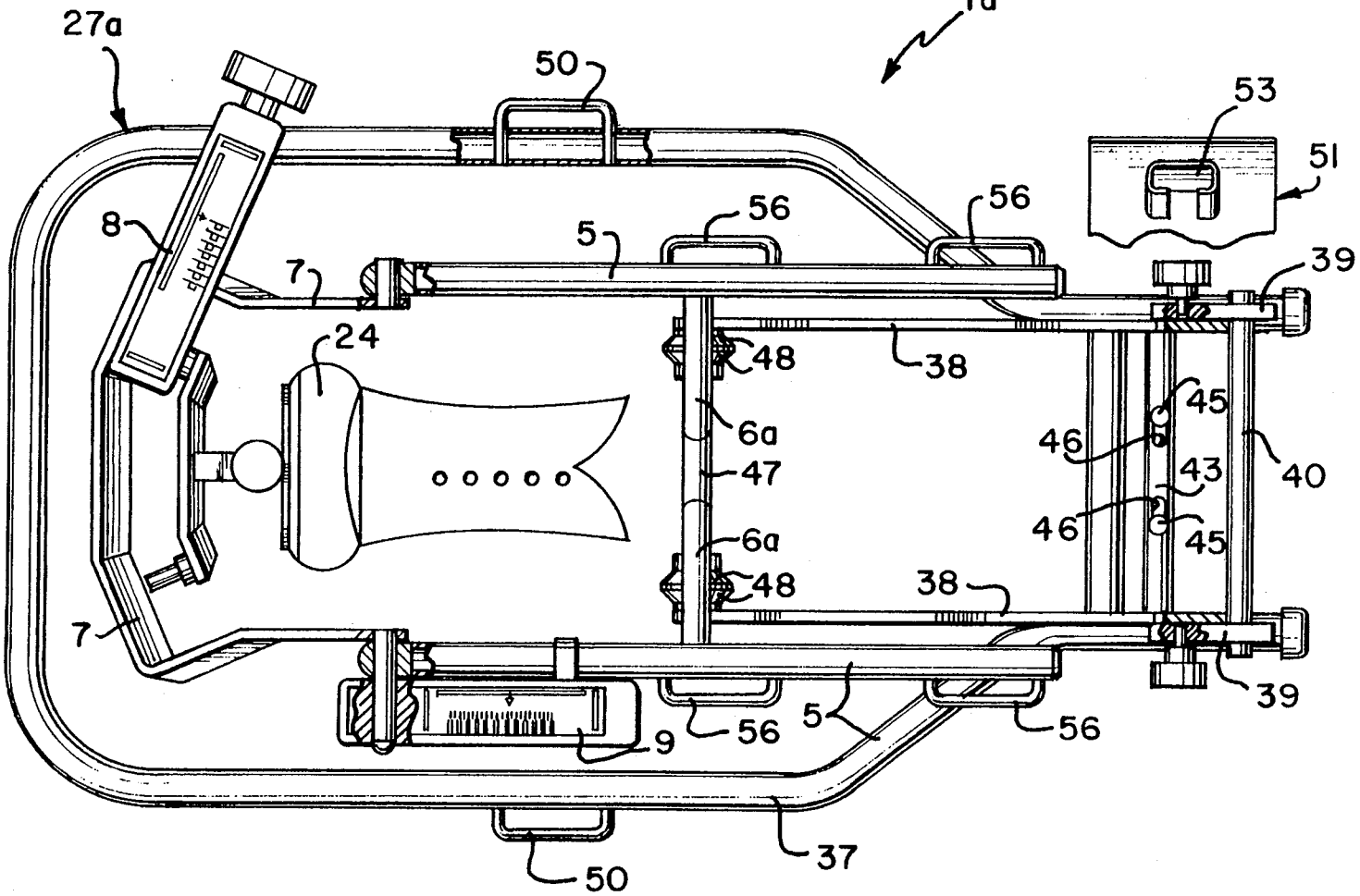
FIG. 6 is a plan view of the modified apparatus of FIG. 5.
Figure 7:
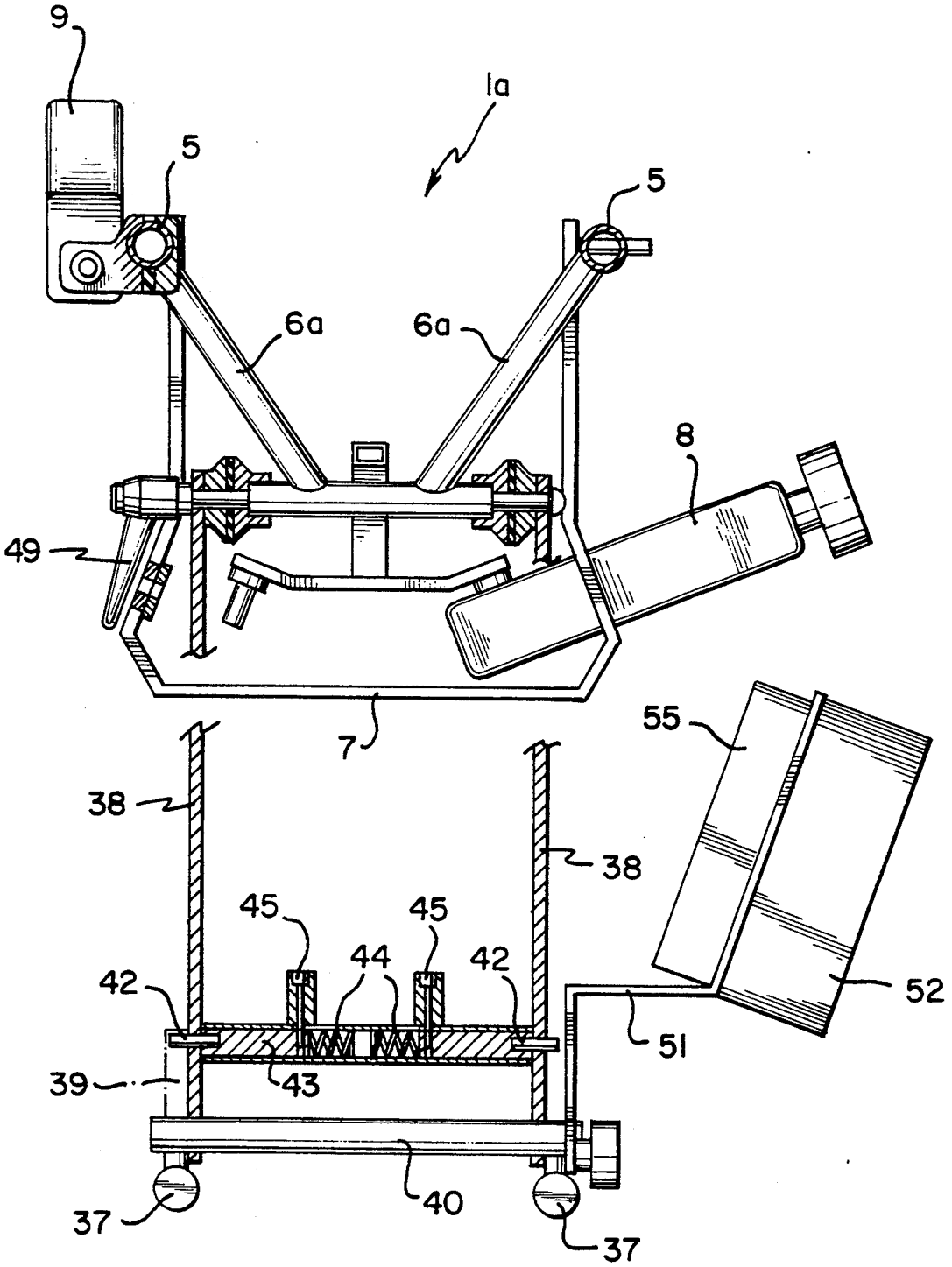
FIG. 7 is a partly rear elevational and partly vertical sectional view of the modified apparatus of FIGS. 5 and 6.

FIGS. 5 to 7 show a second exercising apparatus 1*a* having a modified frame 2*a* with a U-shaped base or holder 27*a* which can be positioned on a mattress, carpet or mat and can be coupled to a bed frame or to another supporting structure (not shown) by suitable coupling means 50. The base 27*a* has two spaced apart parallel or nearly parallel legs 37 which are provided with substantially plate-like bearings 39 for a horizontal pivot member 40. The pivot member 40 carries the lower end portions of two pivotable carrier devices 38, and the upper end portions of these carrier devices mount a horizontal shaft 47 which, in turn, carries the support 3. The weight of the supports 3 and 4 and of the moving means including the prime movers 8 and 9 is borne by the shaft 47 at a level above the base 27*a;* this enhances the stability of the exercising apparatus 1*a*.

A detent is provided to serve as a means for releasably locking the carrier devices 38 in selected angular positions relative to the plane of the base 27*a*, i.e., to locate the support 3 at a desired level above the plane of the base 27*a*. Such locking means includes a first portion constituted by the bearings 39 which are provided with sockets 41 for projections 42 carried by a hollow shaft 43 extending between the two carrier devices 38. The projections 42 are studs or pins which are biased outwardly beyond the respective ends of the shaft 43 by coil springs 44. Handles 45 are provided to permit manual extraction of the projections 42 from selected sockets 41. This enables the person in charge to change the inclination of the carrier devices 38 and hence the level of the support 3. The sockets 41 can constitute through holes or bores and together form an arc with a center of curvature on the axis of the pivot member 40. As shown in FIG. 5, the positioning of sockets 41 is such that the carrier devices 38 can be caused to make with the plane of the base 27*a* an angle of between approximately 30° and 90°. A further possible position for the carrier devices 38 is that of substantial parallelism with the base 27*a;* such position is desirable and advantageous in order to reduce the bulk of the apparatus 1*a* for the purposes of transport or storage. The projections 42 and the sockets (one shown at 41*a* in FIG. 5) can be used to lock the carrier devices 38 in such collapsed positions.

The handles 45 for extraction of the projections 42 from selected sockets 41, 41*a* are reciprocable in axially parallel slots 46 which are provided in the hollow shaft 43. It is preferred to place the two handles 45 sufficiently close to each other to ensure that they can be simultaneously manipulated by one hand of a person in charge. The other hand is then available to perform another step, e.g., to pivot the carrier devices 38 to newly selected angular positions.

The shaft 47 at the upper ends of the carrier devices 38 is or can be rigid with the braces 6*a* for the elongated components 5 of the support 3. In order to permit changes in orientation (inclination) of the support 3 relative to the carrier devices 38, the apparatus 1*a* further comprises means for releasably maintaining the braces 6*a* and the components 5 in selected angular positions relative to the base 27*a* of the frame 2*a*. Such means for releasably maintaining comprises two detents 48 each of which includes a first position on the shaft 47 and a complementary second portion on the adjacent carrier device 38. The two portions of each detent 48 can include toothed discs (FIG. 7) one of which is movable axially of the shaft 47 to thus move its teeth into or out of mesh with the teeth of the adjacent disc. This enables the person in charge to rapidly change the inclination of the support 3. A lever 49 or other actuating means is provided to move the axially movable toothed discs away from the adjacent discs and to thus permit pivoting of the support 3 about the axis of the shaft 47. The lever 49 is then released and the teeth of the axially movable discs are caused to move back into mesh with the teeth of the adjacent discs forming part of the respective detents 48. Springs (not shown) or other suitable means can be provided to yieldably bias the axially movable discs of the detents 48 toward the adjacent discs.

In all other respects, the exercising apparatus 1*a* of FIGS. 5–7 is or can be identical with the apparatus 1 of FIGS. 1–4. The straps or bands 5*a* were omitted in FIGS. 5–7 for the sake of clarity. FIG. 6 shows eyelets 56 which can be connected with the end portions of straps or bands 5*a* forming part of the support 3. The apparatus 1*a* is somewhat simpler than the apparatus 1 and at least some of its parts are more readily accessible.

The coupling means 50 on the legs 37 of the U-shaped base 27*a* of the frame 2*a* can constitute or include eyelets which can be used to receive portions of cables, ropes, straps or like flexible parts serving to secure the base 27*a* to a bed or to another supporting facility.

The apparatus 1*a* of FIGS. 5–7 further comprises a casing 52 which is attached to the base 27*a* by an arm 51 and carries a hook 53 serving to removably support a remote control actuator 55 which is to be manipulated by the patient. The actuator 55 can be provided with an array of suitably distributed knobs, not unlike a remote control actuator for a television receiver, which enable the patient to select the sequence, frequency and/or duration of exercises to be carried out by the upper and/or the lower joint of an ankle between the leg on the support 4 and the lower leg on the support 3 of the apparatus 1*a*. It is clear that a similar actuator can be provided for the apparatus 1 of FIGS. 1 to 4. The reference characters 54 denote in FIG. 5 flexible cables which connect the actuator 55 with the prime movers 8 and 9.

The improved apparatus is susceptible of numerous additional modifications without departing from the spirit of the present invention. For example, certain features of the apparatus 1 or 1*a* can be incorporated into the apparatus 1*a* or 1. Furthermore, the apparatus can be mounted on wheels to facilitate transport in a hospital, a nursing home or a similar establishment.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for exercising an ankle, comprising:

a frame;

a first support for the lower leg of a person desiring to exercise the ankle;

a second support for the foot of the person, said supports being mounted on said frame;

first joint means for permitting first movements performed about a first axis and including dorsal extension and plantar flexion of a foot relative to a lower leg;

second joint means for permitting second movements performed about a second axis and including spination and pronation of the foot;

means for moving at least one of said supports relative to the frame about one of the first and second axes defined by the ankle between the lower leg and the foot on said first and second supports, respectively; and means for adjusting said second support relative to said frame, said adjusting means including a carrier for adjusting a relative position of said second support, said moving means including a primer mover having a first output element connected with and arranged to pivot said carrier and said second support relative to said frame about the first axis said moving means further including a second prime mover mounted between said carrier and said second support and having a second output element connected with and arranged to pivot said second support about the second axis, and means for adjustably coupling said second prime mover to said carrier in any one of a first relative position, at which said second output element is in alignment with the second axis that extends through the ankle of the left foot when the left foot is on said second support, and a second relative position, at which said second output element is in alignment with the second axis that extends through the ankle of the right foot on said second support, said first and second relative positions being spaced from each other.

2. The apparatus of claim 1, wherein said moving means includes one of said prime movers having an output element turnable about a third axis which at least substantially coincides with said first axis of the ankle between the lower leg and the foot on said first and second supports, respectively.

3. The apparatus of claim 1, wherein at least one of said prime movers has an output element turnable about an axis which at least substantially coincides in alignment with the respective axis of the ankle between the lower leg and the foot on said first and second supports, respectively, and means for operating said prime movers.

4. The apparatus of claim 1, further comprising means for operating said prime movers, said operating means including means for starting and arresting said prime movers independently of each other and further comprising means for adjusting at least one of said units relative to the ankle between the lower leg and the foot on said first and second supports, respectively.

5. The apparatus of claim 1, wherein said adjusting means further includes means for adjusting said first support relative to said frame.

6. The apparatus of claim 1, wherein said frame includes a base and means for securing said first support to said base.

7. The apparatus of claim 1, further comprising means for changing the position of said first support relative to said frame.

8. The apparatus of claim 7, wherein said position changing means includes two pairs of arms disposed in substantially parallel planes flanking said first support, the arms of each pair including first portions pivoted to said frame and second portions adjustably connected to each other and mounting said first support.

9. The apparatus of claim 8, wherein said position changing means further comprises means for releasably fixing the second portions of the arms of each of said pairs to each other.

10. The apparatus of claim 9, wherein each of said fixing means is adjustable longitudinally of at least one arm of the respective pair of arms.

11. The apparatus of claim 9, wherein each of said fixing means is secured to the second portion of one arm of the respective pair of arms and includes guide means slidably receiving the other arm of the respective pair of arms.

12. The apparatus of claim 9, wherein said position changing means further comprises a connector between said fixing means, said first support being mounted on said connector.

13. The apparatus of claim 9, wherein said first support is pivotable between a plurality of positions relative to said fixing means about the first axis of the ankle between the lower leg and the foot on said first and second supports, respectively said position changing means further comprising means for releasably locking said first support in a selected position.

14. The apparatus of claim 13, wherein said means for releasably locking comprises an additional arm pivoted to said frame and means for releasably fixing said additional arm to said first support.

15. The apparatus of claim 1, wherein said moving means includes a housing and one of said prime movers being in said housing and having a rotary output element defining a third axis, the ankle between the lower leg and the foot on said first and second supports, respectively, being movable with and/or relative to at least one of said supports to move said one axis of such ankle to a position of at least substantial coincidence with said third axis.

16. Apparatus for exercising an ankle, comprising:

a frame;

a first support for the lower leg of a person desiring to exercise the ankle;

a second support for the foot of the person, said supports being mounted on said frame;

first joint means for permitting first movements performed about a first axis and including dorsal extension and plantar flexion of a foot relative to a lower leg;

second joint means for permitting second movements performed about a second axis and including spination and pronation of the foot;

means for adjusting said second support relative to said frame, said adjusting means including carrier for adjusting a relative position of said second support, said carrier being pivotable relative to said frame about the first axis said carrier having a first side facing toward and a second side facing away from said first support; and means for moving at least one of said supports relative to the frame about one of the first and second axes, said moving means including a prime mover having an output element connected with and arranged to pivot said carrier and said second support relative to said frame about the first axis, said moving means further including a second prime mover mounted between said carrier and said second support and having a second output element connected with and arranged to pivot said second support about the a second axis; said second output element being disposed between the first side of said carrier and the first support, said first support including two elongated spaced apart components pivotally connected to said carrier for permitting relative pivotable movement of said carrier with respect to said components.

17. The apparatus of claim 16, further comprising means for changing the position of said first support relative to said frame, said position changing means including means for moving said first support between a plurality of different levels relative to said frame, said moving means including a lever with one end pivotally connected to said frame and pivotally movable through a plurality of relative positions so that the other end of said lever displaces through a plurality of different elevations in response to the pivotal movement, said first support being in operative connection with the other end of said lever for moving between the plurality of different levels relative to said frame in response to displacement of the other end of said lever through the plurality of different elevations.

18. The apparatus of claim 17, wherein said moving means includes means for moving said second support relative to said first support and said frame.

19. The apparatus of claim 16, wherein said frame includes a base and at least one carrier device movably affixed to said base and mounting said first support, said carrier device including said carrier, said frame including a pivot member between said base and said at least one carrier device, said at least one carrier device being movable relative to said base about a third axis defined by said pivot member between a plurality of different angular positions, said frame further including a detent means for releasably locking said at least one carrier device in a selected angular position; and said frame further including a shaft rotatably supported by said at least one carrier device and mounting said first support, and means for releasably maintaining said shaft and said first support in any one of a plurality of different angular positions relative to said at least one carrier device.

20. The apparatus of claim 19, wherein said frame includes means for separably coupling to a supporting structure.

21. The apparatus of claim 20, wherein said supporting structure includes a bed.

22. The apparatus of claim 19, wherein said moving means includes a motor and a self-locking transmission between said motor and said at least one support.

23. The apparatus of claim 22, wherein said transmission comprises a worm drive.

24. The apparatus of claim 19, wherein said moving means comprises means for operating said prime mover in accordance with at least one predetermined program.

25. The apparatus of claim 24, wherein said operating means includes means for monitoring the position of said at least one support and for generating signals denoting the monitored position.

26. The apparatus of claim 24, wherein said moving means further comprises means for limiting the movability of said at least one support relative to said frame.

27. The apparatus of claim 19, wherein said base includes a substantially U-shaped member.

28. The apparatus of claim 19, wherein said detent means includes at least one bearing for said pivot member, said locking means having at least one first portion on said at least one bearing and at least one second portion complementary in contour to said at least one first portion, each said second portion being provided on said carrier device for engagement with a respective first portion on said bearing.

29. The apparatus of claim 28, wherein one of said portions of said locking means includes a plurality of sockets and the other of said portions of said locking means includes a projection receivable in a selected socket of said one portion.

30. The apparatus of claim 29, wherein said other portion of said locking means is provided on said at least one carrier device and further comprises means for biasing said projection into a selected socket and means for extracting said projection from a selected socket.

31. The apparatus of claim 19, wherein said maintaining means comprises a first detent portion on said shaft and a second detent portion on said at least one carrier device, said detent portions being separably connectable to each other in any one of said plurality of different angular positions of said shaft and said first support relative to said carrier device.

32. The apparatus of claim 19, wherein said first support comprises braces connecting said two elongated components to said shaft.

33. An apparatus as in claim 16, wherein said second output element is arranged so that the second axis passes through said second output element.

* * * * *